United States Patent [19]

Hoover et al.

[11] Patent Number: 4,932,453

[45] Date of Patent: Jun. 12, 1990

[54] PREFABRICATED WINDOW SYSTEM WITH AN OVERHANGING STILL

[75] Inventors: Randy C. Hoover, Lovettsville, Va.; James A. Ruby, Pittsburgh, Pa.

[73] Assignee: Rehau AG & Co., Rehau, Fed. Rep. of Germany

[21] Appl. No.: 224,403

[22] Filed: Jul. 26, 1988

[51] Int. Cl.[5] ..... A47H 1/00

[52] U.S. Cl. ..... 160/90; 49/446

[58] Field of Search ..... 160/90; 52/204, 208; 49/446, 504

[56] References Cited

U.S. PATENT DOCUMENTS 3,959,926 6/1976 Noecker et al. .
4,151,682 5/1979 Schmidt .
4,259,813 4/1981 Winner et al. .
4,555,868 12/1985 Mancuso .

OTHER PUBLICATIONS

*Rehan*, catalog.

*Primary Examiner*—Blair M. Johnson

*Attorney, Agent, or Firm*—Spencer & Frank

[57] ABSTRACT

A prefabricated window system includes a rectangular main frame having a top frame portion, a bottom frame portion, and two side frame portions. The frame portions are extruded thermoplastic elements having substantially the same cross-sectional configuration. The frame portions include first and second channels which, in the side frame portions, serve to guide windows. The frame portions also provide a third channel which, in the side frame portions, serve to guide a screen member. The window system also includes a sill which is connected to the bottom frame portion. The sill includes an extruded thermoplastic element which is snap-connected to the bottom frame portion and which is braced with respect to the bottom frame portion. The sill covers the window channels of the bottom frame portion, and additionally has an overhang portion which covers the screen channel of the bottom frame element to keep debris out. The sill also has a trough for receiving the bottom edge of one of the windows when it is closed, and a seal which is directed toward the trough to limit air incursion.

19 Claims, 3 Drawing Sheets

FIG. 6
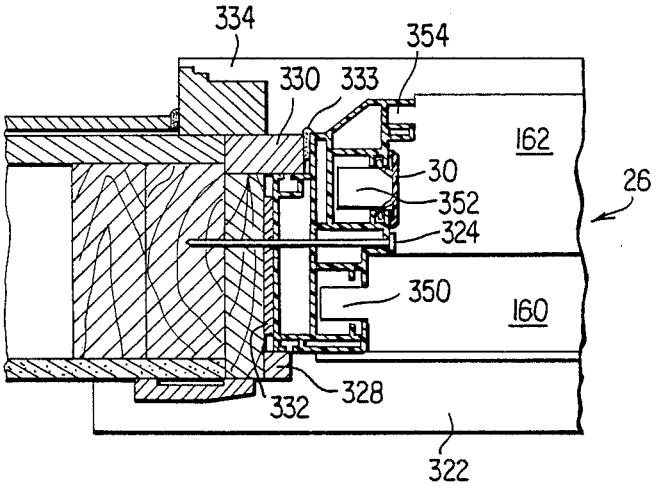
FIG. 8
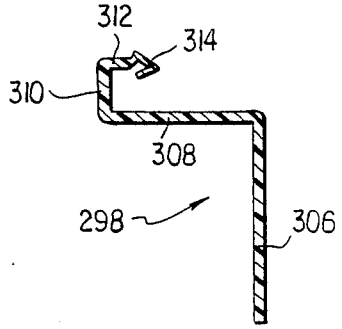
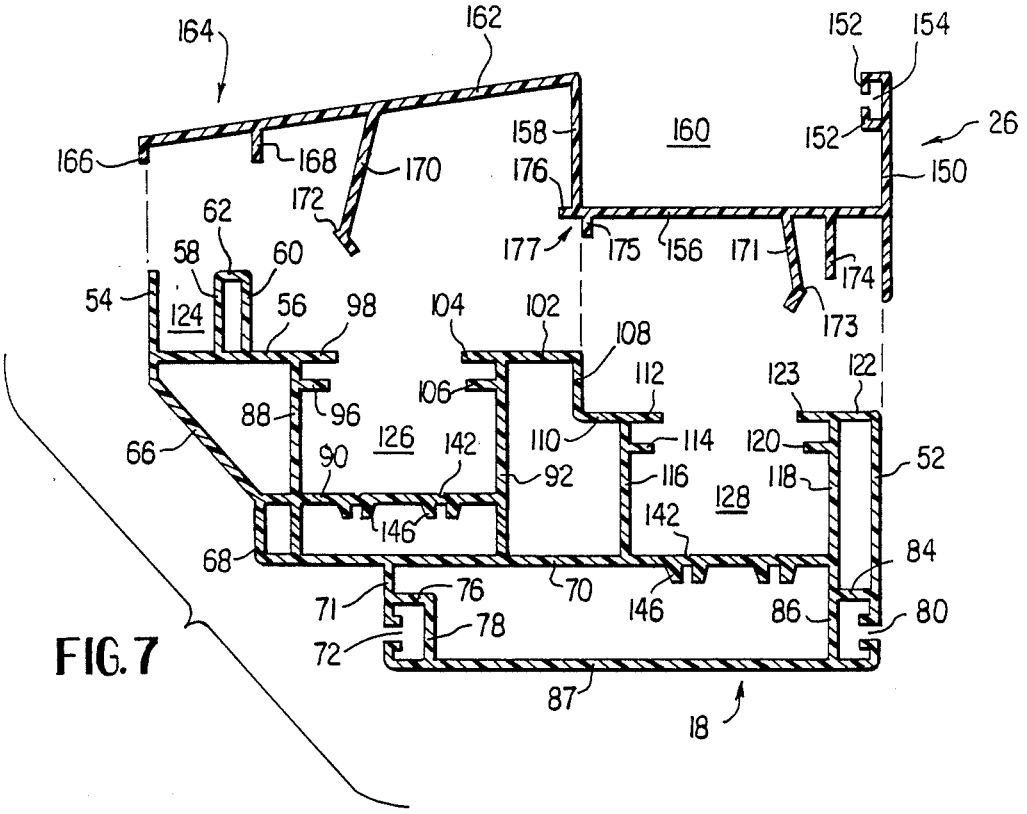
FIG. 7

PREFABRICATED WINDOW SYSTEM WITH AN OVERHANGING STILL

BACKGROUND OF THE INVENTION

The present invention relates to a prefabricated window system, and more particularly to a prefabricated window system having a main frame and other elements including a sill which are fabricated from extruded thermoplastic members.

Prefabricated windows are frequently used, both for new construction and replacement purposes, in order to provide high quality at a moderate cost. The desireable attributes of a prefabricated window are easier to state than to achieve. The window should be relatively inexpensive both to purchase and to install, but it should nevertheless offer excellent security against the elements. Furthermore the window should be attractive and sufficiently rugged to withstand abuse. Finally, these qualities should be present not only at the time of installation but for many years thereafter.

The S 771 (TM) prefabricated window system of Rehau Incorporated, having an office in Leesburg, Va., achieves the aforesaid qualities to an admirable degree. The S 771 window is described in a pending application, Ser. No. 06/929,303, filed Nov. 12, 1986, which is incorporated hereby by reference. Briefly, the window system disclosed in this application includes a rectangular main frame having a top frame portion, a bottom frame portion, and two side frame portions. The frame portions are made from extruded vinyl and all have the same cross-sectional configuration or profile except for features such as drainage channels which are fabricated after extrusion. The side frame portions provide channels for guiding two window sashes and a screen member, and since the top and bottom frame portions have the same cross-sectional configuration as the side frame portions such channels are also present in the top and bottom frame portions. Primarily to improve the appearance of the window, a snap-in decorative panel covers one of the window channels in the top frame portion. An extruded vinyl sill having closed internal compartments is provided at the bottom frame portion. The sill has resilient legs by which the sill is snap-connected to flanges which extend into the window channels of the bottom frame portion. The sill covers the window channels of the bottom frame portion.

In the window system of the aforesaid pending application, the screen channel of the bottom frame portion is exposed to the elements. While water can be drained by drilling a bore through the screen channel, it has been found that debris occasionally accumulates in the screen channel of the bottom frame portion to an undesirable degree. Unless such debris is cleared away, either by the rain or the homeowner, it may collect in uneven piles which prevent the screen member from being fully lowered. Thus the accumulated debris is not only unsightly, in extreme cases it may cause gaps at the bottom edge of the screen member and thus permit insects to enter the house.

SUMMARY OF THE INVENTION

One object of the invention is to provide a prefabricated window system having a main frame with a screen channel which does not collect debris.

Another object of the invention is to provide a prefabricated window system having an improved sill which is connected to a bottom portion of a main frame and which overhangs and thus shields a screen channel in the bottom portion.

These and other objects which will become apparent in the ensuing detailed description can be attained by providing a prefabricated window system having a main frame which is made from extruded thermoplastic frame portions having substantially the same cross-sectional configuration. At the sides of the main frame, the frame portions provide channels for guiding two window sashes and a screen member. A sill has resilient legs which snap into flanges extending into the window channels of the bottom frame member. The sill also has an overhanging portion which covers the screen channel in the bottom frame portion to shield it from debris. To help brace the sill, the overhanging portion has downwardly extending flanges which overlap walls of the bottom frame portion adjacent the screen channel.

BRIEF DESCRIPTION OF THE DRAWINGS

FIG. 6 is a top plan view of one end of the sill and a sectional view through one side frame portion of the window system, which is installed in an alternate manner.

FIG. 7 is a sectional view through the bottom frame portion and the sill; and FIG. 8 is a sectional view of a nailing fin employed in FIG. 4 and 5.

DESCRIPTION OF THE PREFERRED EMBODIMENTS

Figure 3:
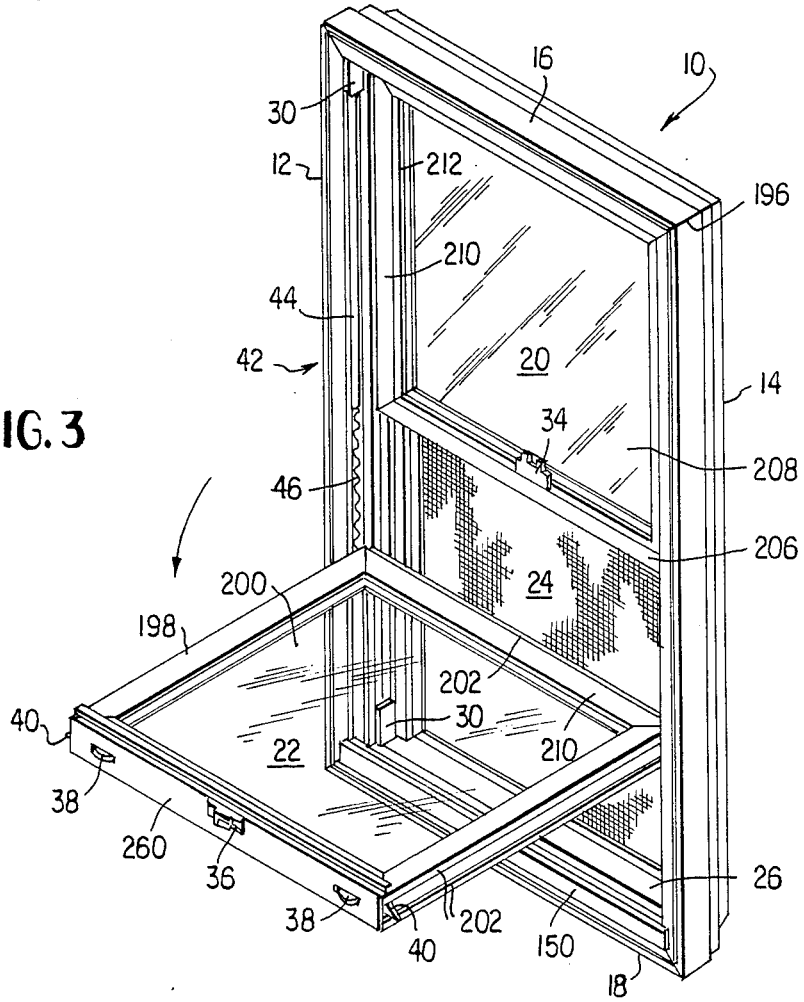
FIG. 3 is a perspective view of the window system in its un-installed state.
Figure 5:
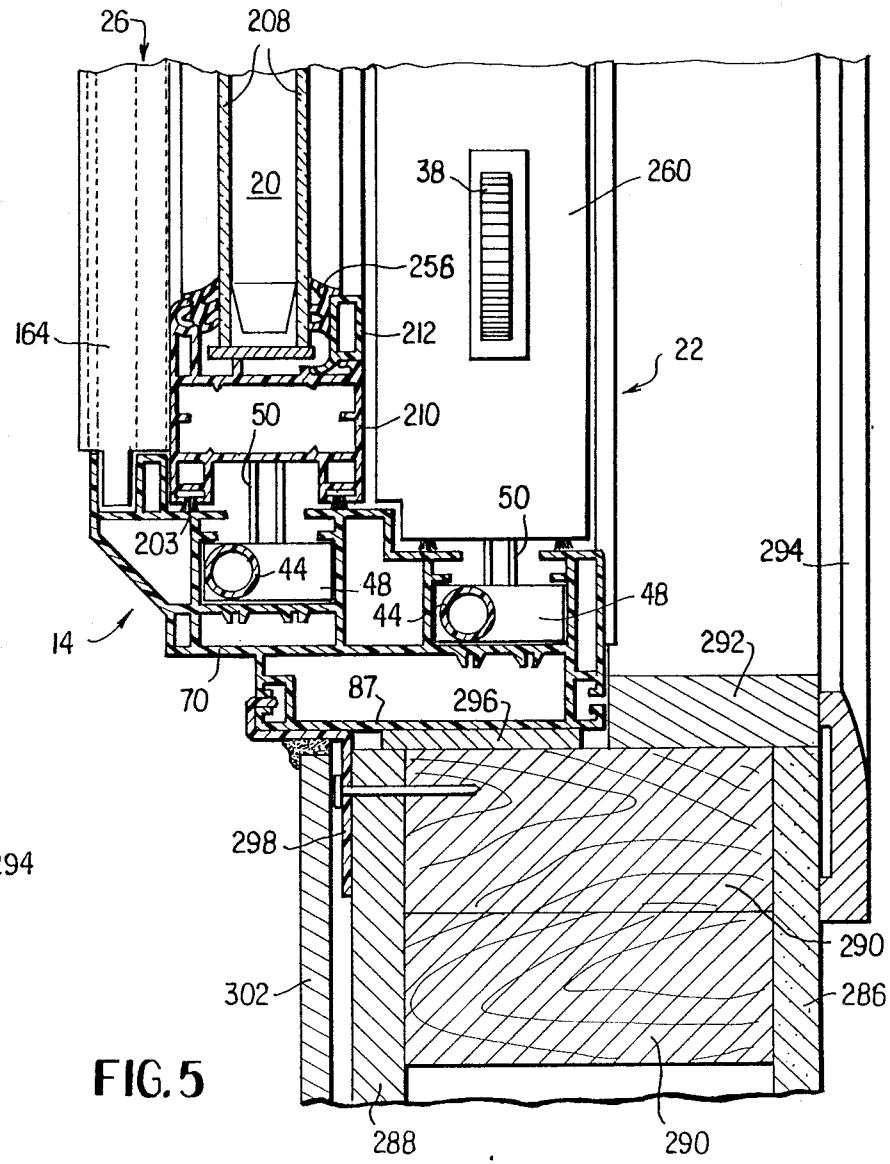
FIG. 5 is a sectional view, taken along line 5—5 of FIG. 1, illustrating the window system in its installed state.

A window system in accordance with the present invention is illustrated generally in FIG. 3 in its uninstalled state, and includes a main frame 10 having side frame portions 12 and 14, a top frame portion 16, and a bottom frame portion 18. The window system also includes top window 20, bottom window 22, and screen member 24, which are slidably mounted in channels provided by side frame portions 12 and 14. A sill 26 is mounted on bottom frame portion 18, and a decorative panel 28 (see FIG. 1) is mounted on top frame portion 16. Stop elements 30 are mounted in side frame portions 12 and 14 to prevent bottom window 22 from being moved upwards far enough to smash into the handle 32 (see FIG. 1) of top window 20, and to prevent top window 20 from being moved downward far enough for handle 32 to smash into bottom window 22. The window system also includes window mounting means, which will be described later, and hardware such as keeper 34, latch 36, buttons 38 for actuating retractable tilt latch mechanisms 40, and balance mechanisms 42. Typically either two balance mechanisms 42 (one on each side) or four (two on each side) are used with each of windows 20 and 22, depending on their size and weight. Each balance mechanism 42 includes spring (not illustrated) which is coiled within a tube 44 and which is connected via a link 46 to a slidably mounted window attachment mechanism 48 (FIG. 5). Pivot bars 50 (see FIG. 5) extend from the bottom of either window to engage mechanisms 48.

FIG. 7 illustrates a cross-sectional view of sill 26 and bottom portion 18 of frame 10. Frame 10 is preferably fabricated from a length of an extruded thermoplastic such as vinyl which is cut into sections for use as frame portions 12, 14, 16, or 18. That is to say, each of these portions has the same general cross-sectional configuration, although for purposes of description the configuration illustrated in FIG. 6 has been identified as portion 18. Portion 18 in FIG. 6 could alternatively have borne reference number 12, 14, or 16.

Frame portion 18 includes a wall 52 which faces the interior of the building in which the window system is installed and a wall 54 which faces the outside. An inner wall 56 faces the interior of frame 10 (see FIG. 3) and is attached to wall 54. Walls 58 and 60, which are connected by a bridge 62, are supported by wall 56. A sloping web 66 connects wall 54 to a wall 68, which terminates at intermediate wall 70. Wall 71 extends outward from wall 70 and has a slot 72. Walls 76 and 78 are disposed behind slot 72 to provide a chamber into which slot 72 communicates. In a similar manner wall 52 is interrupted by a slot 80 which is closed off by walls 84 and 86. Outer wall 87 faces away from the interior of frame 10 (see FIG. 3) and connects wall 52 to wall 71.

With continuing reference to FIG. 7, wall 88 extends between wall 56 and wall 70. An intermediate wall 90 connects wall 88 to wall 92, which extends inward from wall 70. A flange 96 is connected to wall 88, and wall 56 terminates at a flange 98. Wall 92 extends to a wall 102, which terminates in a flange 104. Connected to wall 92 is a flange 106 parallel to flange 104. A step 108 connects wall 102 to a wall 110 having a flange 112. A flange 114 extends from a wall 116, which connects wall 110 to wall 70. Facing wall 116 is a wall 118 having a flange 120. A wall 122 connects wall 52 to wall 118 and terminates in a flange 123.

It will be apparent that the various walls and panels heretofore described provide channels 124, 126, and 128, along with various chambers as illustrated.

Two grooves 142 are molded into wall 90 and into wall 70. Also molded into wall 90 and wall 70 are a pair of screw bosses 146 corresponding to each groove 142.

The features identified by reference numbers 52 through 146 are present in each of frame portions 12, 14, 16, and 18 (see FIG. 3). However not all of these features are utilized in the same way in each of the frame portions. For example, grooves 142 and screw bosses 146 have no function in top frame portion 16 and bottom frame portion 18, and are present in these frame portions only because of their utility in side frame portions 12 and 14. The tubes 44 (see FIG. 3) of balance mechanisms 42 are attached to side frame portions 12 and 14 and grooves 142 and bosses 146 are used to facilitate this attachment. The tubes 44 are secured to frame portions 12 and 14 by sheet metal screws (not illustrated). Grooves 142 and bosses 146 extend the entire length of side frame portions 12 and 14 (as, indeed, they extend the entire lengths of top and bottom frame portions 16 and 18), and accordingly during fabrication of the window system a screw can be slid to the desired height along a groove 142 and then screwed in with confidence that it is aligned with bosses 146 on the other side to reliably secure the screw. Although two grooves 142 and their corresponding bosses 146 are provided in each of channels 126 and 12 in FIG. 7, and only one tube 44 is mounted in each of the corresponding channels of FIG. 5, it will be recalled that additional balance mechanisms may be needed with large windows.

Figure 1:
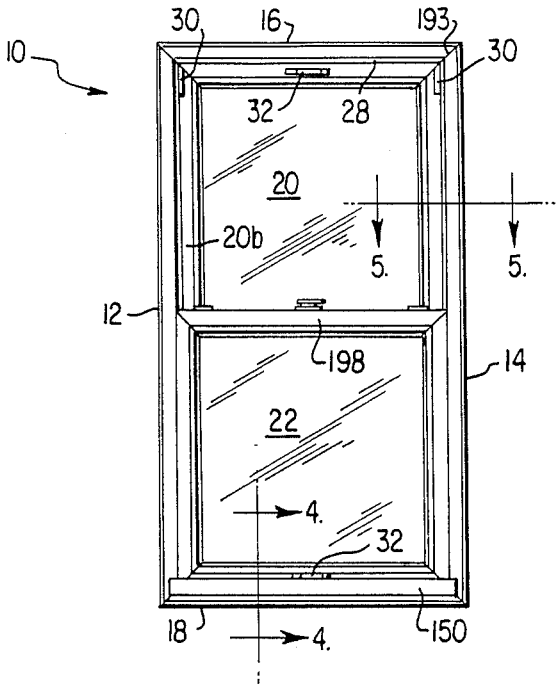
FIG. 1 is a front view of a window system in accordance with the present invention in its un-installed state.
Figure 2:
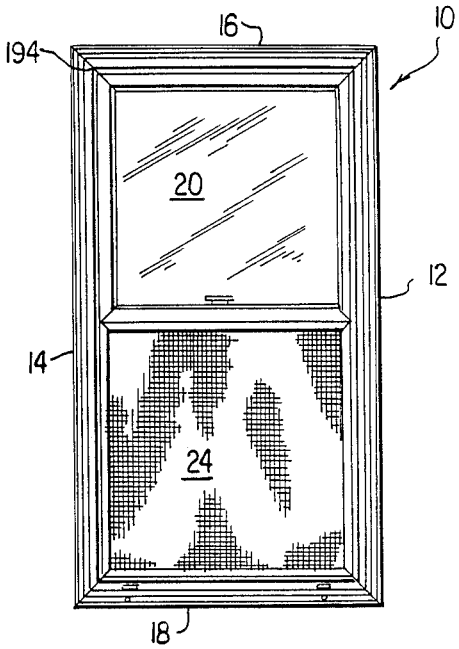
FIG. 2 is a rear view of the window system in its un-installed state.

Referring next to FIGS. 1, 2, and 3, frame portions 12, 14, 16, and 18 are joined at the corners by interior welds 193, exterior welds 194, and lateral welds 196, and these corner welds imparting both rigidity and a finished appearance to main frame 10. In this context the term "weld" means that the corners have been joined by molten thermoplastic which, when it cools, seals one frame portion with an adjacent portion along a smooth seam. Panel 28 and stop elements 30 are not welded to main frame 10. Although not illustrated, one side of panel 28 has resilient legs which snap onto flanges 112 and 123 (see FIG. 7) of top frame portion 16, thereby covering channel 128. This increases the aesthetic appeal of the window system. Stop elements 30 also have resilient legs (not illustrated) which permit them to be snap-connected to side frame portions 12 and 14. Panel 28 and stop elements 30 preferably have the same cross-sectional configuration, so that either can be cut from a length of extruded vinyl. At the bottom of main frame 10, frame portion 18 preferably has drainage channels (not illustrated) which are drilled after extrusion. With reference to FIG. 7, holes are preferably drilled into wall 68, 88, 92, and 116, just above wall 70, and into wall 90 at the bottom of channel 126, to provide such drainage.

With continuing reference to FIG. 7, sill 26 is fabricated from an extruded length of vinyl having the cross section or profile illustrated. Sill 26 includes an inner wall 150 from which extend bracket portions 152 which are spaced apart to define a slot 154. A brush seal 155 (see FIG. 4) is inserted into slot 154. A bottom wall 156 is connected between wall 150 and an intermediate Wall 158, thereby providing a sash-receiving trough 160. A sloping web 162 extends from intermediate wall 158 and terminates in an overhang portion 164.

Gripper flanges 166 and 168 extend downward from the underside of overhang portion. Also extending downward from the underside of sill 26 are resilient legs 170 and 171, which are provided respectively with hooks 172 and 173. Flanges 174 and 175 extend downward from wall 156, which terminates in an end flange 176. Flanges 175 and 176 define an L-shaped support bracket 177.

Figure 4:
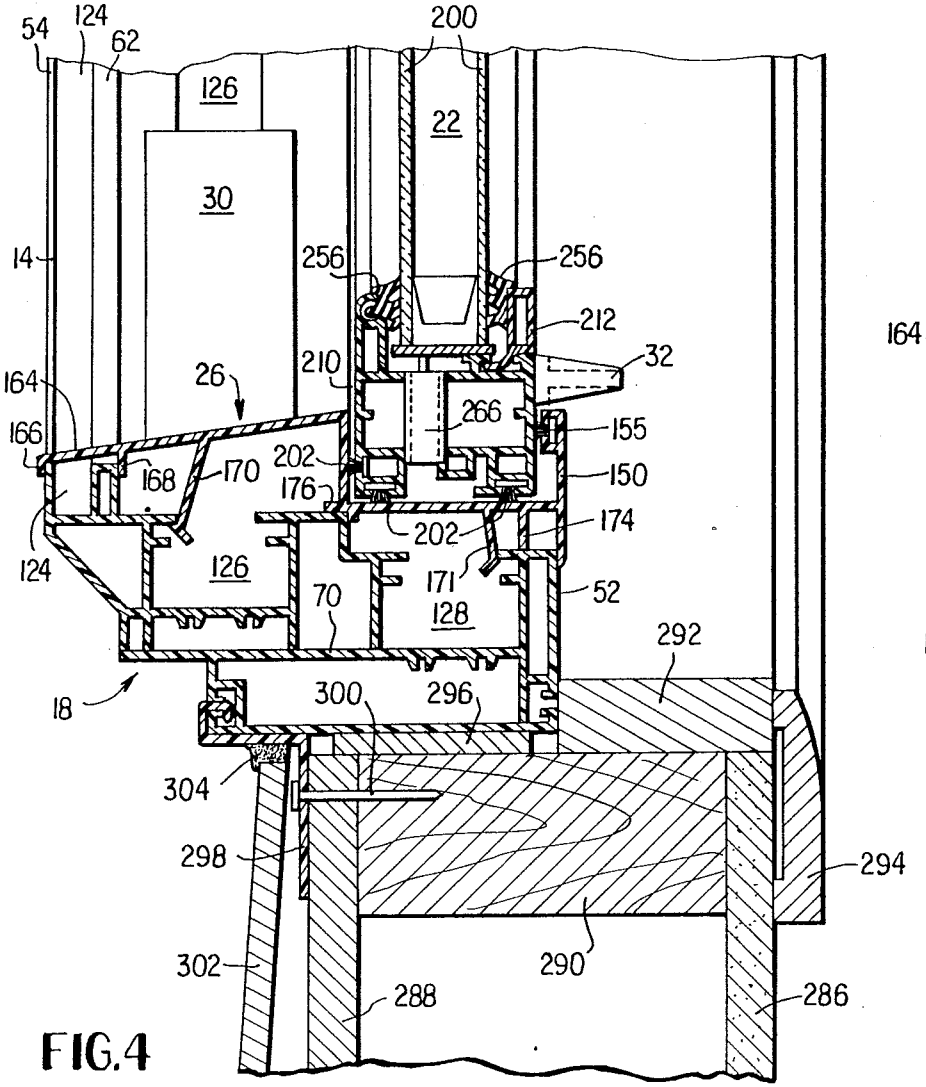
FIG. 4 is a sectional view, taken along line 4—4 of FIG. 1, illustrating the window system in its installed state.

Referring next to FIGS. 4 and 7 together, the installation of sill 26 on bottom frame portion 18 will now be described. Sill 26 is snap-connected to frame portion 18 by being forced downward. As this occurs, leg 170 is bent slightly counterclockwise by the edge of flange 9 and leg 171 is bent slightly clockwise by the edge of flange 123. With further downward movement, hook 172 clears flange 98 and leg 170 snaps back so that hook 172 latches against the underside of flange 98. Similarly, hook 173 latches against the underside of flange 123. In this installed position, the bottom portion of wall 150 overlaps the outer side of wall 52; the end of flange 174 rests on wall 122 immediately above wall 118; support bracket 177 fits over the corner at the intersection of wall 102 and step 108; and the underside of overhang portion 164 rests on the top of wall 54 and bridge 62, with gripper flanges 166 and 168 overlapping the sides of walls 54 and 60. As a result, sill 26 is solidly supported on bottom frame portion 18. Hooks 172 and 173 prevent sill 26 from being inadvertently raised. Flanges 166, 168, and 175 prevent lateral movement of sill 126, as does the bottom portion of wall 150. Finally, sill 26 is supported from below at overhang portion 164, support bracket 177, and flange 174. This support from below keeps the vinyl of sill 26 from being bent even if significant downward force is exerted on it.

Referring next to FIGS. 3, 4, and 5, window 22 includes a sash 198 in which an insulated glazing unit 200 (which includes two panes of spaced-apart glass) is mounted. Weather proofing elements such as brush seals 202 are mounted at the edges of sash 198. Top window 20 similarly includes a sash 206, glazing unit 208, and brushed seals 203.

Each of sashes 198 and 206 includes four sash portions 210 of extruded thermoplastic, sash portions 210 being welded to one another at the corners. A cover element 260 is snap-connected to the top sash portion 210 of sash 198 and, although not illustrated, a similar cover element is snap-connected to the bottom sash portion 210 of sash 206. These cover elements are preferably provided with interlock lips which cooperate when windows 20 and 22 are in the closed position to inhibit air incursion. Cover element 260 has openings through which buttons 38 protrude.

Glazing beads 212 hook on to the sash portions 210 at the indoor sides thereof. Resilient glazing splines 256 are mounted on glazing beads 212 and on the outdoor sides of sash portions 210. Tubes 266 extend through the bottom sash portion 210 of each window to drain any condensation or any water which may have leaked through glazing splines 256.

FIGS. 4 and 5 are sectional views taken respectively along lines 4—4 and 5—5 of FIG. 1, except that screen member 24 is not shown and the window system has been installed in a building. In FIGS. 4 and 5, interior and exterior panels 286 and 288 are supported by framing members such as two by fours 290. During construction an opening is left for the window system, and the interior portion of this opening is lined with strips 292. Internal trim 294 is also attached. After this preparation has been completed, the window system is inserted into the opening through the outer side of the wall, with shims 296 being used to avoid gaps. Nailing fins 298 are plugged into main frame 10, as will be discussed, and are secured to the wall by nails 300. Thereafter outer siding 302 is applied and the window system is sealed thereto by caulk 304. It will be apparent that differences in construction and material may lead to variations in the installation procedure that has been described.

Because of the reduced scale of FIGS. 4 and 5 it is appropriate to continue the discussion of nailing fin 298 with reference to FIG. 8. Nailing fin 298 is preferably an extruded thermoplastic element having a cross-sectional configuration as illustrated. An attachment portion 306 is connected to an outwardly extending portion 308, which in turn is connected by a bridge portion 310 and an insertion portion 312 to an arrowhead portion 314. During installation of nailing fin 298, extending portion 308 is pressed against wall 87 (see FIG. 7) of the appropriate frame portion 12, 14, 16, or 18, with arrowhead portion 314 poised to enter the slot 72 (see FIG. 7). The bridge portion 310 is then pounded with a rubber mallet (not illustrated) to drive arrowhead portion 314 through slot 72. The nails 300 are driven through attachment portion 306 as previously discussed.

While slot 72 is provided to receive nailing fin 298, slot 80 (see FIG. 7) is not present for this purpose. Slot 80 is provided for use in the event that two windows systems are to be mounted side-by-side. In this case, a tying element (not illustrated) is pounded into the slot 80 of one window system and into the slot 80 of the adjacent window system. A similar tying element (not illustrated) connects the adjacent slots 72 on the outside of the window systems.

Installation of the window system as shown in FIGS. 4 and 5, with the aid of nailing fin 298, is primarily intended for new construction. FIG. 6 illustrates the window installed as a replacement for a wooden window (not illustrated) that was previously present. In this situation structures such as window ledge 322 may remain from the previous installation. Frame 10 is centered in the opening with the aid of shims 332, and is mounted by driving nails 324 through holes (not illustrated) provided in frame 10. Additionally, inner and outer strips 328 and 330, caulk 333, and external trim 334 are installed.

Referring to FIGS. 6 and 7 together, at each end of sill 26 there is a tab 350 which extends into channel 128, a tab 352 which extends into channel 126 beneath stop element 30, and a tab 354 which extends into channel 124.

It will be understood that the above description of the present invention is susceptible to various modifications, changes, and adaptations, and the same are intended to be comprehended within the meaning and range of equivalents of the appended claims.

What we claim is:

1. A window system, comprising:

a generally rectangular main frame having a top frame portion, a bottom frame portion, and a pair of spaced-apart side frame portions which connect the top and bottom frame portions, each frame portion including a respective thermoplastic element having first, second, and third channels, the frame portions having substantially identical cross-sectional configurations;

a first window;

first means extending into the first channels of the side frame portions for slidably mounting the first window in the main frame;

a second window;

second means extending into the second channels of the side frame portions for slidably mounting the second window in the main frame;

a screen member slidably mounted in the frame member, the screen member extending into the third channels of the side frame portions; and a sill which covers the first, second, and third channels of the bottom frame portion, the sill including third means cooperating with the bottom frame portion for snap-connecting the sill to the bottom frame portion and fourth means cooperating with the bottom frame portion for bracing the sill on the bottom frame portion, the sill additionally including a sloping web covering the second and third channels of the bottom frame portion, the web having a thickness which is substantially less than the width of the third channel.

2. The window of claim 1, wherein the sill has an upper portion, the upper portion covering the first, second, and third channels of the bottom frame portion, the upper portion of the sill and the third and fourth means being a unitary element of extruded thermoplastic.

3. The window of claim 2, wherein the thermoplastic is vinyl.

4. The window of claim 2, wherein the upper portion of the sill has a trough into which the lower portion of the first window fits when the first window is in a lowered position.

5. The window of claim 4, wherein the sill further comprises a seal and means for mounting the seal adjacent to the trough.

6. The window of claim 1, wherein the web has a substantially flat upper surface.

7. The window of claim 1, wherein the bottom frame portion comprises a first vertical frame wall and a second vertical frame wall, the third channel of the bottom frame portion being disposed between the first and second vertical frame walls, and wherein the fourth means comprises a first sill flange extending downward from the web to contact the first frame wall of the bottom frame portion and second sill flange extending downward from the web to contact the second frame wall of the bottom frame portion.

8. The window of claim 7, wherein the bottom frame portion further comprises a frame flange adjacent the second channel of the bottom frame portion, and wherein the third means comprises a resilient leg extending downward from the web, and a hook on the leg to latch onto the frame flange.

9. The window of claim 1, wherein the sill further compromises a horizontally disposed sill wall covering the first channel of the bottom frame portion, the horizontally disposed sill wall having a thickness that is substantially less than the width of the third channel.

10. The window of claim 9, wherein the bottom frame portion further comprises a frame wall facing the interior of the building, a further frame wall disposed between the first channel of the bottom frame portion and the frame wall facing the interior of the building, and a horizontally disposed additional frame wall which is connected to the frame wall facing the interior of the building and to the further frame wall, and wherein the fourth means comprises a sill wall extending downward from the horizontally disposed sill wall and contacting the frame wall facing the interior of the building, and another sill wall which extends down from the horizontally disposed sill wall and which has an end that abuts the additional frame wall.

11. The window of claim 10, wherein the another sill wall has an end which lies directly above the further frame wall.

12. The window of claim 10, wherein the bottom frame portion further comprises a frame flange adjacent the first channel of the bottom frame portion, and wherein the third means comprises a resilient leg extending downward from the horizontally disposed sill wall and a hook on the resilient leg to latch onto the frame flange adjacent the first channel.

13. The window of claim 9, wherein the bottom frame portion further comprises means for defining a corner portion between the second and third channels of the bottom frame portion, and wherein the fourth means further comprises an L-shaped bracket connected to the horizontally disposed sill wall to contact the corner portion.

14. The window of claim 9, wherein the horizontally disposed sill wall is lower than the web of the sill, and wherein the sill further comprises connecting means for connecting the horizontally disposed sill wall to the web, the connecting means having a thickness which is substantially less than the width of the third channel.

15. The window of claim 14, wherein the connecting means comprises a vertically disposed sill wall.

16. The window of claim 15, wherein the sill further comprises an additional vertically disposed sill wall spaced apart from the vertically disposed sill wall connecting the horizontally disposed sill wall with the web of the sill, and a seal mounted on the additional vertically disposed sill wall.

17. The window of claim 1, wherein the web has a bottom side that is exposed to the second and third channels.

18. The window of claim 1, wherein the sill additionally comprises a trough into which the lower portion of the first window fits when the first window is in a lowered position, the trough having a trough bottom that is positioned lower than at least a portion of the web.

19. The window of claim 18, wherein the third and fourth means are connected to the web and the trough bottom.

* * * * *